US006375037B1

(12) United States Patent
Bell et al.

(10) Patent No.: US 6,375,037 B1
(45) Date of Patent: Apr. 23, 2002

(54) BAG CONSTRUCTION FOR DISTRIBUTING MATERIAL

(75) Inventors: Gary M. Bell, Crystal; Bobby Hira, Bloomington, both of MN (US)

(73) Assignee: Kapak Corporation, St. Louis Park, MN (US)

( * ) Notice: Subject to any disclaimer, the term of this patent is extended or adjusted under 35 U.S.C. 154(b) by 0 days.

(21) Appl. No.: 09/686,132

(22) Filed: Oct. 10, 2000

(51) Int. Cl.[7] ..... B67B 7/00

(52) U.S. Cl. ..... 222/1; 206/439; 383/209; 222/107; 222/478

(58) Field of Search ..... 222/1, 478, 107, 222/565; 206/439; 383/102, 103, 106, 209

(56) References Cited

U.S. PATENT DOCUMENTS

| | | | | |
|---|---|---|---|---|
| 383,327 | A | | 5/1888 | Starr |
| 2,001,149 | A | | 5/1935 | Monschein |
| 2,163,324 | A | | 6/1939 | Reinhold |
| 2,390,822 | A | | 12/1945 | Wren |
| 2,442,646 | A | | 6/1948 | Fields |
| 2,865,768 | A | | 12/1958 | Barnes et al. |
| 3,159,096 | A | | 12/1964 | Tocker |
| 3,174,644 | A | | 3/1965 | Kaltman et al. |
| 3,229,813 | A | | 1/1966 | Crowe, Jr. et al. |
| 3,456,867 | A | | 7/1969 | Repko |
| 3,741,778 | A | | 6/1973 | Rowe |
| 3,807,118 | A | | 4/1974 | Pike |
| 3,827,341 | A | | 8/1974 | Stage |
| 3,980,225 | A | | 9/1976 | Kan |
| 3,991,801 | A | | 11/1976 | Ausnit |
| 4,000,846 | A | | 1/1977 | Gilbert |
| 4,191,230 | A | | 3/1980 | Ausnit |
| 4,206,870 | A | | 6/1980 | DeVries |
| 4,526,565 | A | | 7/1985 | Hummel et al. |
| 4,532,652 | A | | 7/1985 | Herrington |
| 4,553,693 | A | | 11/1985 | Terajima et al. |
| 4,576,316 | A | | 3/1986 | Foster |
| 4,741,909 | A | | 5/1988 | Guthrie |
| 4,913,693 | A | | 4/1990 | Ball et al. |
| 5,035,516 | A | | 7/1991 | Pacheco |
| 5,059,036 | A | | 10/1991 | Richison et al. |
| 5,080,155 | A | | 1/1992 | Crozier |
| 5,709,479 | A | | 1/1998 | Bell |
| 5,882,120 | A | | 3/1999 | Bell |
| 6,120,817 | A | * | 9/2000 | Archibald et al. ..... 383/102 |
| 6,131,733 | A | * | 10/2000 | Ergle et al. ..... 206/439 |

FOREIGN PATENT DOCUMENTS

| | | |
|---|---|---|
| AT | 230565 | 12/1963 |
| BE | 516001 | 12/1952 |
| CA | 1106317 | 8/1981 |
| DE | 22 65 145 A1 | 9/1976 |
| DE | 2933-151 A1 | 2/1981 |
| EP | 0 345 930 A1 | 12/1989 |
| EP | 0 537 109 A2 | 4/1993 |
| FR | 1513052 | 2/1968 |
| GB | 1204462 | 9/1970 |
| JP | 2-4651 | 1/1990 |
| JP | 3-133747 | 6/1991 |
| JP | 3-289451 | 12/1991 |
| WO | WO 94/00363 | 1/1994 |

* cited by examiner

*Primary Examiner*—Philippe Derakshani
*Assistant Examiner*—Thach H Bui
(74) *Attorney, Agent, or Firm*—Merchant & Gould P.C.

(57) ABSTRACT

A bag construction for use to distribute flowable material includes first and second panel sections oriented juxtaposed to one another. In one end of the bag construction, a gusset with distribution apertures are provided. This permits distribution of a flowable material in the interior of the bag construction. At another end of the bag construction, a stand-up, solid, unperforated gusset is provided. This gusset permits the bag construction to stand in an upright position, for display and storage purposes. Methods of preparing and using such arrangements are described.

28 Claims, 4 Drawing Sheets

BAG CONSTRUCTION FOR DISTRIBUTING MATERIAL

TECHNICAL FIELD

This disclosure relates to bag or pouch constructions. In particular, it relates to an arrangement from which a flowable material can be readily distributed, conveniently, by a user. The disclosure also concerns methods for preparing such arrangements and methods of using such arrangements.

BACKGROUND

A wide variety of items include materials, which, in use, are dispersed or spread over an area. Many of these items are flowable material, such as dry powder or particulate materials. Examples of these materials include grass seed, plant nutrients, insect dust, salt pellets, and colored chalk.

In use, such materials are generally dispersed over some surface. For those materials that are dispersed over the ground or plants, sometimes mechanical spreading equipment is used. While the equipment can be quite effective, it is often large, bulky, and is generally only desirable if a relatively large amount of material is to be spread over a relatively large area.

In many instances, mechanical spreading equipment is not appropriate. In addition, mechanical spreading equipment may need to be thoroughly cleaned between uses, which can be inconvenient.

In some instances, spreading has involved either hand spreading or spreading with a hand-held scoop of some type. This can be inconvenient and messy.

Alternate arrangements for spreading materials have been desirable.

SUMMARY OF THE DISCLOSURE

A pouch arrangement is provided. The pouch arrangement includes first and second opposed panel sections. In preferred embodiments, each of the panel sections has opposite first and second ends and first and second side edges extending between the first and second ends. Preferred arrangements include a first stand-up gusset fold member oriented between the first and second panel sections along the first and second panel section first ends. Preferred embodiments also include a second gusset oriented between the first and second panel sections along the first and second panel section second ends. The second gusset includes a distribution aperture arrangement. For example, the second gusset may include a plurality of holes or slits therein, to allow flowable material to pass therethrough, selectively, in use. Preferred embodiments also include a handle along the first and second panel section first ends.

Preferred methods of filling a pouch construction are provided. Preferred methods include providing a pouch construction having an interior, a first gusset fold member at a first end of the pouch construction, and a second gusset at a second end of the pouch construction. In preferred embodiments, the second gusset will include a plurality of apertures, and the second end of the pouch construction will have a seal therealong to block external access to the second gusset. Preferred methods will include a step of at least partially filling the pouch construction interior with a flowable material through an opening in the pouch construction. The opening may be adjacent to the first gusset fold member or between the first and second end.

In preferred methods, after the step of at least partially filling the pouch, the opening, either adjacent to the first gusset fold member or between the first and second end, will be sealed to close access to the pouch construction interior. In preferred embodiments, this step will transform the first gusset fold member into a closed, stand-up gusset or the opening between the first and second end into a side seal respectively. This will permit the pouch construction to be displayed in a stand-up orientation, resting upon the first gusset.

Preferred methods of using pouch constructions as described herein will include providing a pouch having an interior, a first end, and a second opposite end. Preferably, there will be a stand-up gusset at the first end, an end seal at the second end, and a flowable material in the pouch interior. Preferred methods will include removing the end seal from the pouch to expose a second gusset. The second gusset will preferably include a distribution aperture arrangement.

Preferred methods will also include a step of orienting the pouch such that the gusset having the distribution aperture arrangement is located below the stand-up gusset. In other words, in preferred embodiments, the pouch construction will be inverted to point the gusset having the distribution aperture arrangement toward the ground. In preferred methods, the pouch is then shaken to distribute the flowable material from the pouch interior through the aperture arrangement, by the use of gravity and through the second gusset. Preferred embodiments also include grasping the handle and shaking the pouch to distribute the flowable material.

The disclosure includes within its scope: empty pouch arrangements with an opening through the first stand-up gusset fold member to be filled with material; pouch arrangements with material filled and stored therein; pouch arrangements with the end seal adjacent to the second gusset torn therefrom, methods of distributing particulate material utilizing such pouch arrangements; methods of preparation of such pouch arrangements; and methods of displaying such pouch arrangements in a stand-up configuration.

In the detailed description, discussions of each of these items are provided.

DETAILED DESCRIPTION

Figure 1:
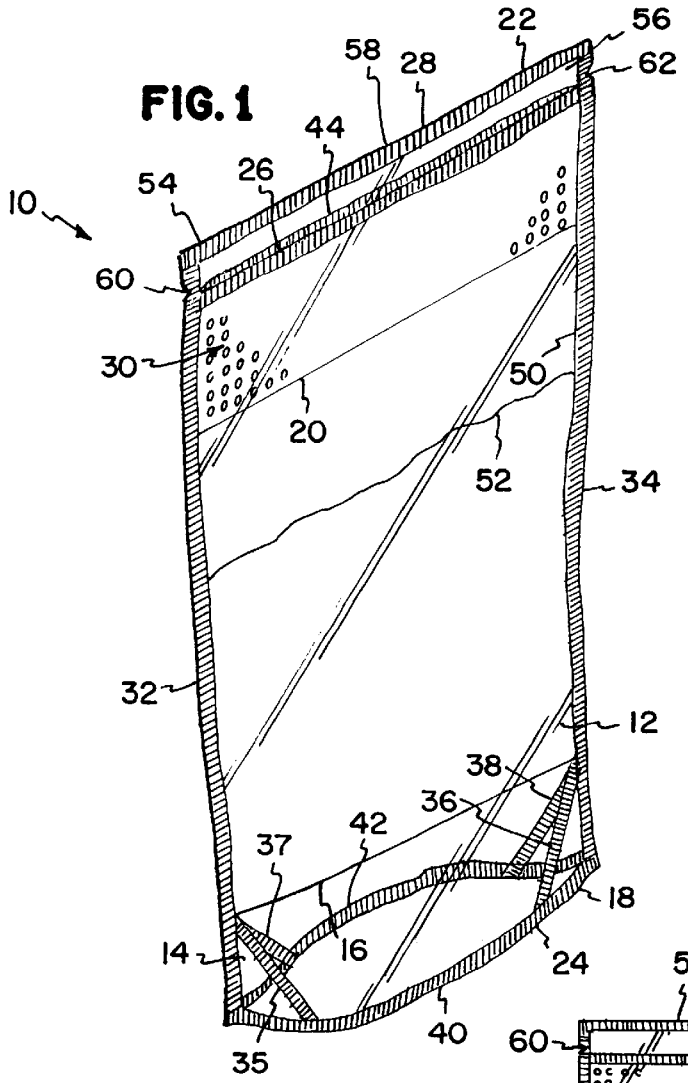
FIG. 1 is a perspective view of one embodiment of a bag arrangement oriented in a stand-up configuration, constructed according to principles of this disclosure.

A bag construction or pouch arrangement constructed according to principles of this disclosure is illustrated in FIG. 1 generally at 10. The particular arrangement 10 is shown as if prepared from substantially transparent materials. In this manner, internal detail can be readily seen. From descriptions below with respect to useful materials, it will be apparent that non-transparent materials may be utilized for constructions according to principles of this disclosure.

Referring still to FIG. 1, the pouch arrangement 10 depicted in FIG. 1 is illustrated as it would generally appear after being filled with material 52 and before being opened for use. The configuration in FIG. 1 is a stand-up configuration. That is, the pouch arrangement 10 in FIG. 1 is shown as it would be displayed, for example, for sale on a store shelf.

Still referring to FIG. 1, pouch arrangement 10 includes first and second opposed sidewalls, panel sections or panels 12, 14. There is also a first gusset 16 at a first end 18 of the pouch arrangement 10, and a second gusset 20 at a second end 22 of the pouch arrangement 10. In FIG. 1, the first gusset 16 is shown in an expanded configuration, to permit the pouch arrangement 10 to stand-up and rest upon the first end 18. As such, the first gusset 16 may also be referred to as a "stand-up gusset." The first end 18 of the pouch arrangement 10 corresponds to the bottom 24 of the pouch arrangement 10, when the pouch arrangement 10 is in a standing configuration.

In FIG. 1, the second gusset 20 is shown in a stored or nonexpanded position. The second gusset is not accessible from the exterior of the pouch arrangement 10, due to an end seal 26 securing the first and second panel sections 12, 14 together and blocking access to the second gusset 20. The second end 22, in FIG. 1, also corresponds to a top 28 of the pouch arrangement 10, when the pouch arrangement 10 is in its stand-up configuration.

The second gusset 20 includes a distribution aperture arrangement 30 to allow for desirable passage of particulate or flowable material therethrough to facilitate distribution.

A typical operation of pouch arrangement 10 will be apparent from review of FIG. 1. In use, the pouch arrangement 10 is displayed in a stand-up configuration resting on bottom 24 with the first gusset 16 expanded to support remaining portions of the pouch arrangement 10. The second gusset 20 is secured inside of the pouch arrangement 10 by the end seal 26. When it is desired to use the pouch arrangement 10 for distribution, the end seal 26 is removed from remaining portions of the pouch arrangement 10, and the second gusset 20 is exposed. Pouch arrangement 10 is then inverted, such that the second gusset 20 is located downwardly relative to the first gusset 16. If the user then shakes the pouch construction 10, flowable particulate material within the pouch arrangement 10 will be dispensed through the distribution aperture arrangement 30 in the second gusset 20. The user can readily control distribution, by simply orienting the arrangement 10 above the object or area over which distribution of the particulate material is desired and shaking the bag appropriately.

Still referring to FIG. 1, the first and second panel sections 12, 14 are secured, and preferably sealed, to one another, along side seals 32, 34. Seals 32, 34, in preferred embodiments, are heat seals. They may be formed in a manner conventional for pouch constructions. As can be seen in FIG. 1, side seals 32, 34 extend between the top 28 and bottom 24 of the pouch construction 10. In some embodiments, the side seals 32, 34 may include a plurality of spaced, inwardly extending projections to help support the pouch arrangement 10 in a standup configuration, without bending or yielding. This is described more fully in commonly assigned U.S. Pat. No. 5,971,613, which patent is incorporated by reference herein.

Figure 2:
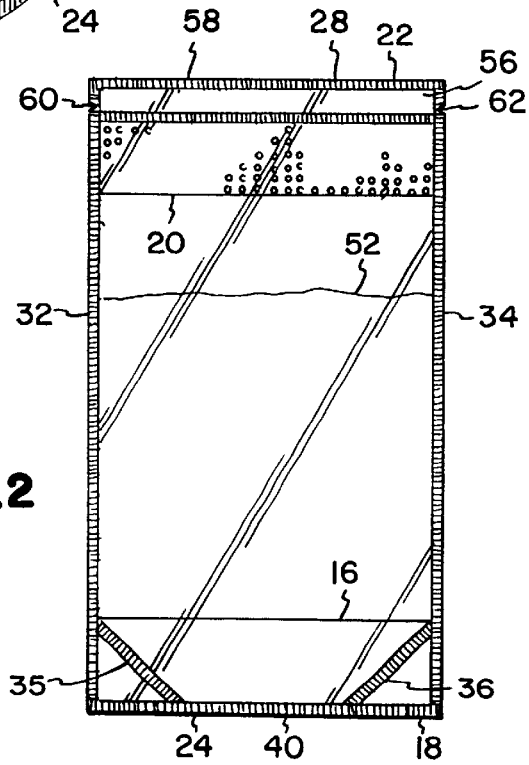
FIG. 2 is a front elevational view of the bag arrangement depicted in FIG. 1.

Each of the first and second gussets 16, 18 are also secured, preferably by heat seals, to the first and second panel sections 12, 14. In reference to FIGS. 1 and 2, the first gusset 16 is secured to panels 12, 14 at seal regions 35, 36, 37, 38. These seals may be conventional, for the formation of standup pouch constructions, such as those illustrated in U.S. Pat. Nos. 5,059,036; 5,147,272; and 5,254,073, incorporated herein by reference. The standup gusset 16, when the pouch arrangement 10 is in a final, assembled form, is also secured to each of the first and second panel sections 12, 14 along end seals 40, 42. Specifically, end seal 40 secures, preferably by heat seal, the first panel section 12 to the first gusset 16 along the edges of the first end 18. The end seal 42 secures the second panel section 14 to the first gusset 16 along the end edges of the first end 18 of the second panel section 14. As will be described in further detail below, the end seal 42 is preferably applied after the pouch arrangement 10 is filled with material.

Figure 4:
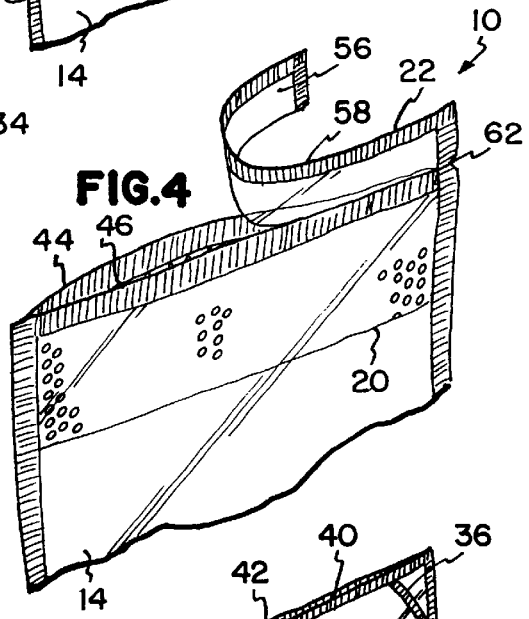
FIG. 4 is a fragmented, perspective view of the bag arrangement shown in FIGS. 1 and 2, during a step of tearing an end seal off of one end of the bag arrangement.
Figure 5:
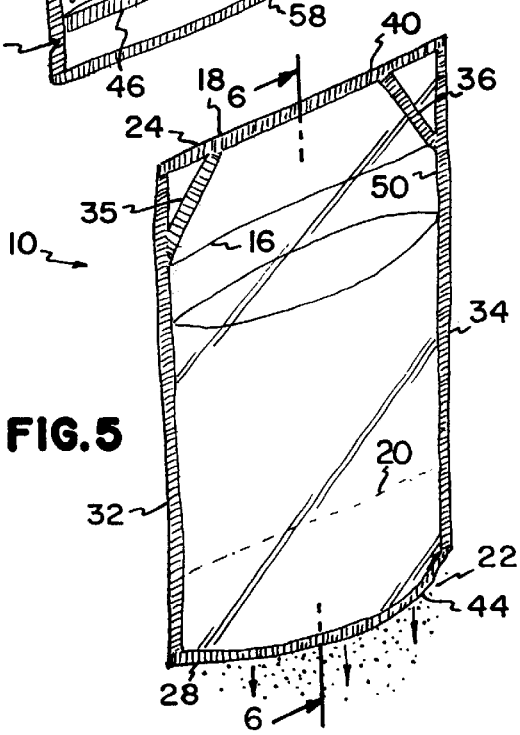
FIG. 5 is a perspective view of the arrangement shown in FIG. 4, after a step of tearing off the end seal and exposing the perforated gusset for spreading material.
Figure 6:
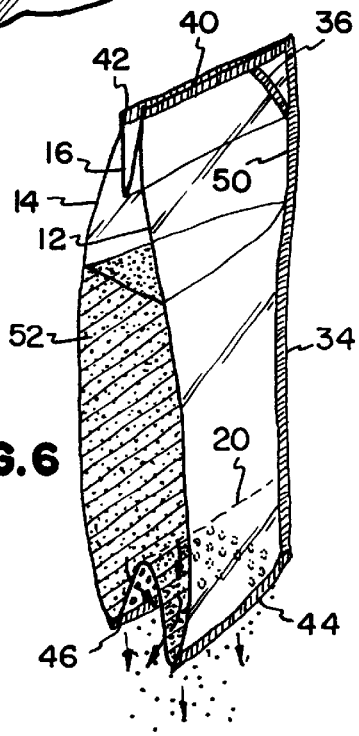
FIG. 6 is a perspective, cross-sectional view taken along the line 6—6 of FIG. 5.

The second gusset 20 is also secured to the first and second panel sections 12, 14. Preferably, the second gusset 20 is secured to the panel sections 12, 14 by way of heat seals 44, 46 (FIGS. 4 and 6). Preferably, the seals 44, 46 extend between the side seals 32, 34.

In general, panels 12, 14 define pouch interior volume 50, generally defined by side seals 32, 34, first gusset 16 and second gusset 20. Interior volume 50 is used for holding or containing flowable particulate material 52 for distribution through the aperture arrangement 30 in the second gusset 20.

On a side 54 of the seals 44, 46 opposite from the internal volume 50, panels 12, 14 define a tab 56 sealed along an end seal 58. The pouch arrangement 10 may include an alternate weakened transverse tear line to facilitate removal of the tab 56, when desired. The score or perforated line may extend transversely across tab 56 from side seal 32 to side seal 34. Pouch arrangement 10 may also include tear notches 60, 62 to facilitate removal of the tab 56. In constructions where a perf or score line is used, the notches 60, 62 will be in alignment. In general, tab 56 should be sized appropriately so that tab 56 can be readily torn from arrangement 10 by hand. Alternatively, the tab 56 can be sized such that it is removed from the pouch arrangement 10 by cutting with a scissors. FIG. 4 shows the tab 56 partially removed from the pouch arrangement 10.

Attention is now directed to FIGS. 3A–6. From a review of these figures, further regarding assembly and operation of arrangements, such as pouch arrangement 10, will be understood.

Figure 3A:
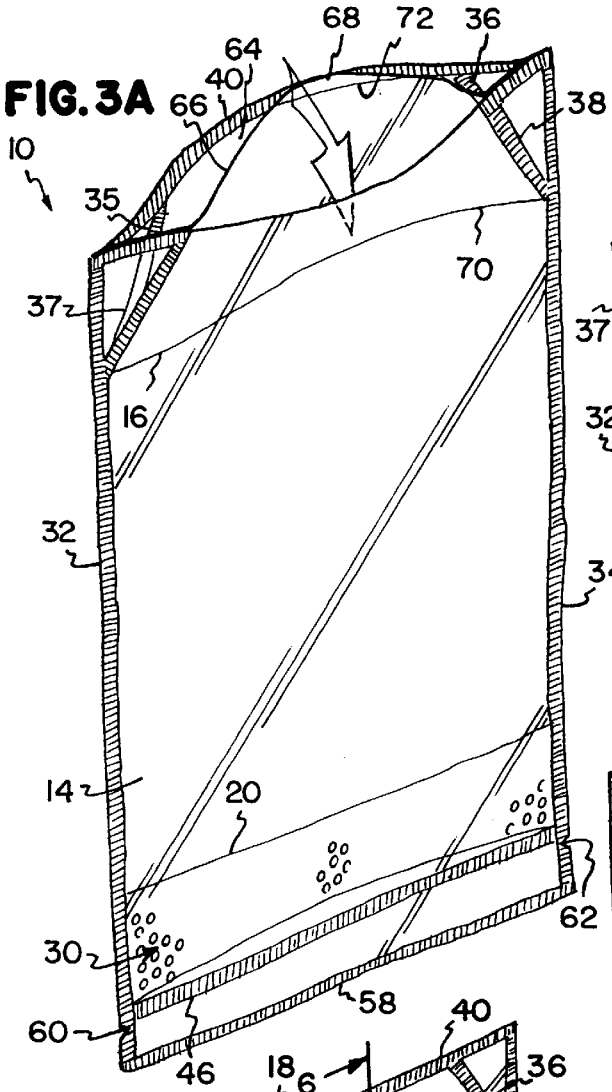
FIG. 3A is a perspective view of the bag arrangement depicted in FIG. 1 during a filling operation through an opening in a stand-up gusset fold member.

Referring to FIG. 3A, the first gusset 16 is shown in a stage before being completely sealed or secured to the first and second panel sections 12, 14. In particular, in FIG. 3A, the first gusset 16 is shown with a first gusset section 64 secured to the first panel section 12 along end seal 40, while a second gusset section 66 has a portion 68 that is unsecured to either of the first and second panel sections 12, 14. As can be seen in FIG. 3A, the first gusset section 64 and the second gusset section 66 are preferably a single piece of material joined along gusset fold 70. The second gusset section 66 and the first and second panel sections 12, 14 define an opening or slit 72 therebetween. The opening 72 provides access to the pouch interior 50.

Figure 3B:
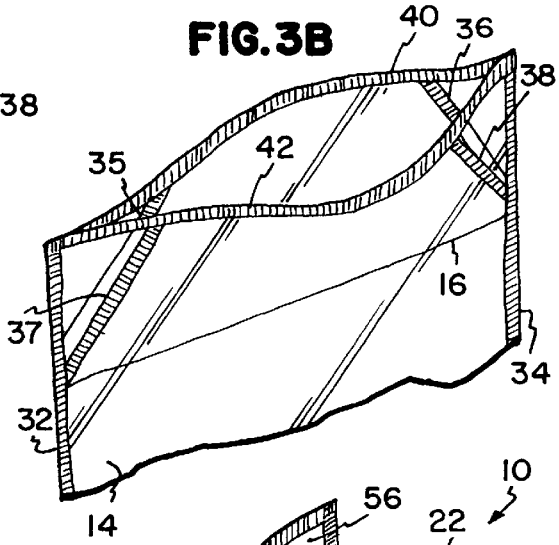
FIG. 3B is a fragmented, perspective view of the bag arrangement depicted in FIG. 3A after the filling operation and after the opening in the stand-up gusset fold member has been sealed.

Thus, it can be appreciated that the pouch arrangement 10 may be filled with material 52 through the opening 72. After filling the pouch arrangement 10 with material 52, the opening 72 may be closed, in order to provide a closed, stand-up gusset (that is, gusset 16). In FIG. 3B, the gusset 16 is shown after the opening 72 has been closed. In the particular embodiment illustrated, the opening 72 is closed by way of end seal 42, preferably by heat, by securing portion 68 to panel section 14. After forming the end seal 42, the pouch arrangement 10 is in a condition to be turned to rest on the bottom 24 and stand-up on its first gusset 16.

Referring to FIG. 4, pouch arrangement 10 is illustrated during a step of removing tab 56 therefrom, in order to allow for the opening of second end 22. Tab 56 is shown being torn from the pouch arrangement 10, and in some embodiments, along a score line or perforated line. In some embodiments, the tab 56 is removed by cutting with a scissors, for example.

Once tab 56 has been completely removed from the pouch arrangement 10, the material 52 may be distributed through the second gusset 20. This may be accomplished by inverting the pouch arrangement 10 from the orientation shown in FIG. 1 and FIG. 4, to the orientation shown in FIG. 5. That is, the pouch arrangement is turned upside down, such that the first end 18 is oriented over or above all other portions of the pouch arrangement 10, while second end 22 is oriented below all other portions of the pouch arrangement 10. Typically, the pouch arrangement 10 is grasped along some combination of the sides 32, 34 and first end 18 and shaking.

After a selected amount of particulate material 52 has been distributed, the arrangement 10 can be stored by inverting the pouch arrangement 10, to stand on its stand-up gusset 16. That is, the pouch arrangement 10 is turned such that the second end 22 is oriented over or above all other portions of the pouch arrangement 10, while first end 18 is oriented below all other portions of the pouch arrangement 10. The stand-up gusset 16 permits the pouch arrangement 10 to be stored in a stand-up, upright position, and without the loss of material 52 within.

Figure 8:
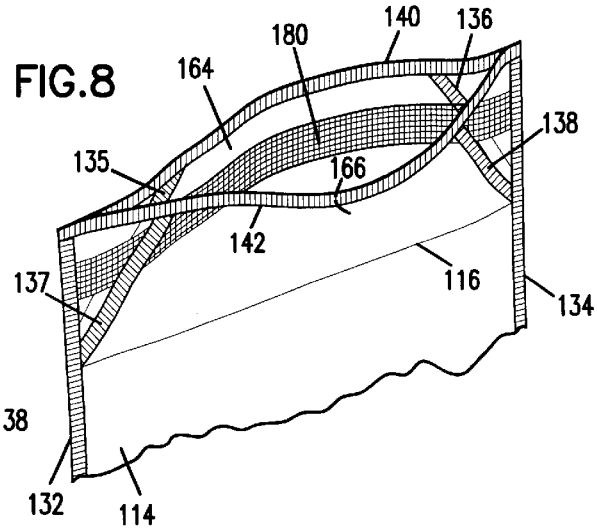
FIG. 8 is a fragmented, perspective view of the bag arrangement depicted in FIG. 7 after the filling operation and after the opening in the stand-up gusset fold member has been sealed.
Figure 7:
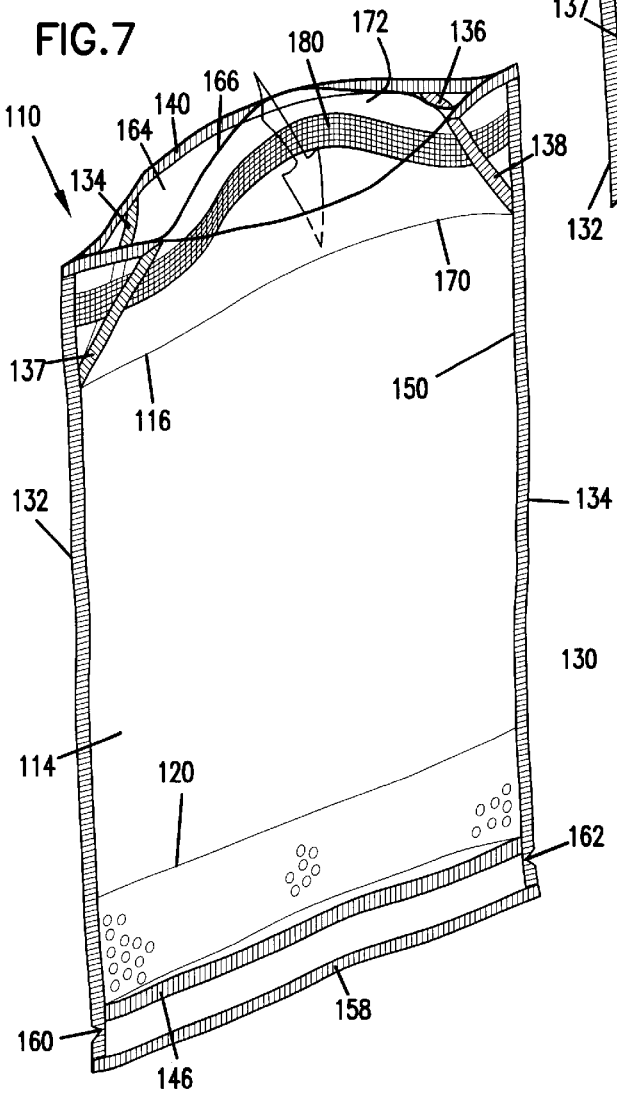
FIG. 7 is a perspective view of an alternate embodiment of a bag arrangement; the bag being shown during a filling operation through an opening in a stand-up gusset fold member.
Figure 9:
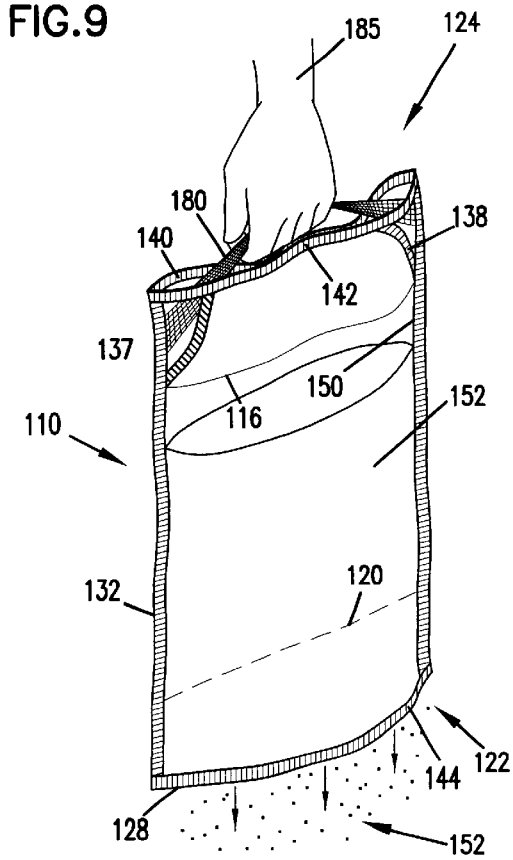
FIG. 9 is a perspective view of the arrangement shown in FIG. 8, after a step of tearing off the end seal and exposing the perforated gusset for spreading material; a hand is shown holding the handle.

Attention is now directed to FIGS. 7–9. From a review of these figures, a further embodiment will be understood regarding placement, construction and use of a handle 180 on a pouch arrangement 110.

Referring to FIG. 7, the first gusset 116 is shown in a stage before being completely sealed or secured to the first and second panel sections 112, 114. In particular, in FIG. 7, the first gusset 116 is shown with a first gusset section 64 secured to the first panel section 112 along end seal 140, while a second gusset section 66 has a portion of 168 that is unsecured to either of the first and second panel portions 112, 114. As illustrated in FIG. 7, the first gusset section 164 and the second gusset section 166 are preferably a single piece of material joined along gusset fold 170. The second gusset section 166 and the first and second panel sections 112, 114 define an opening or slit 172 therebetween. The opening 172 provides access to the pouch interior 150. A handle 180 is disposed between the first gusset section 164 and the second gusset section 166. The handle 180 extends between the side seals 132, 134. The handle 180 is fixed at the side seals 132, 134 by any conventional means such as heat sealing for example.

The handle 180 can be constructed of any conventional material. Preferably, the handle is constructed of polymeric materials and may include reinforcing materials such as polymers, fibers, metal and the like. The handle 180 is affixed to side seals 132, 134 so that the handle 180 and side seals 132, 134 support the weight of the pouch arrangement and flowable material 152 held within the pouch arrangement 110.

The handle 180 should be wide enough so that when a user holds the handle 180, the handle 180 does not "cut in" to the user's hand causing the user pain. However, the handle 180 should not be so wide that the width of the handle prevents the side seals 132, 134 from sealing completely. The handle 180, may be, for example, about a 0.25 to 2 in., preferably, 0.5 to 1.5 in. wide.

The handle 180 should also be strong enough to support the weight of the pouch arrangement 110 and material 152 held within the pouch arrangement 110. The handle 180 may have a plurality of reinforcing strips running along the length of the handle providing the handle 180 with the necessary strength to support the pouch arrangement and material held within.

The pouch arrangement 110 maybe filled with flowable material 152 through the opening 172. After filling the pouch arrangement 110 with the flowable material 152, the opening 172 may be closed, in order to provide a closed, stand-up gusset (that is gusset 116). In FIG. 8, the gusset 116 is shown after the opening 172 has been sealed. In the particular embodiment illustrated, the opening 172 is closed by way of end seal 142 preferably by heat, by securing portion 168 to panel section 114. Handle 180 is connected at side seals 132, 134 and disposed between first gusset section 164 and second gusset section 166. After forming the end seal 142, the pouch arrangement 110 is in the condition to be turned to rest on the bottom and stand-up on its first gusset 116.

As discussed above, FIG. 4 illustrates a step of removing tab 56 from the pouch arrangement 10 in order to allow for the opening of the second end 22. This step applies to this embodiment also. Once tab 156 has been completely removed from the pouch arrangement 110, the material 152 may be distributed through the second gusset 120. This may be accomplished by inverting the pouch arrangement 110 from the orientation shown in FIGS. 1 and 4 to the orientation shown in FIG. 9. That is the pouch arrangement is turned upside down, such that first end 118 is orientated over or above all other portions of the pouch arrangement 110, while second and 122 is orientated below all other portions of pouch arrangement 110. FIG. 9 illustrates the pouch arrangement 110 grasped by the handle 180 by a hand. After a selected amount of particular material 152 has been distributed, the arrangement 110 can be stored by inverting the pouch arrangement 110 as described earlier.

Figure 10:
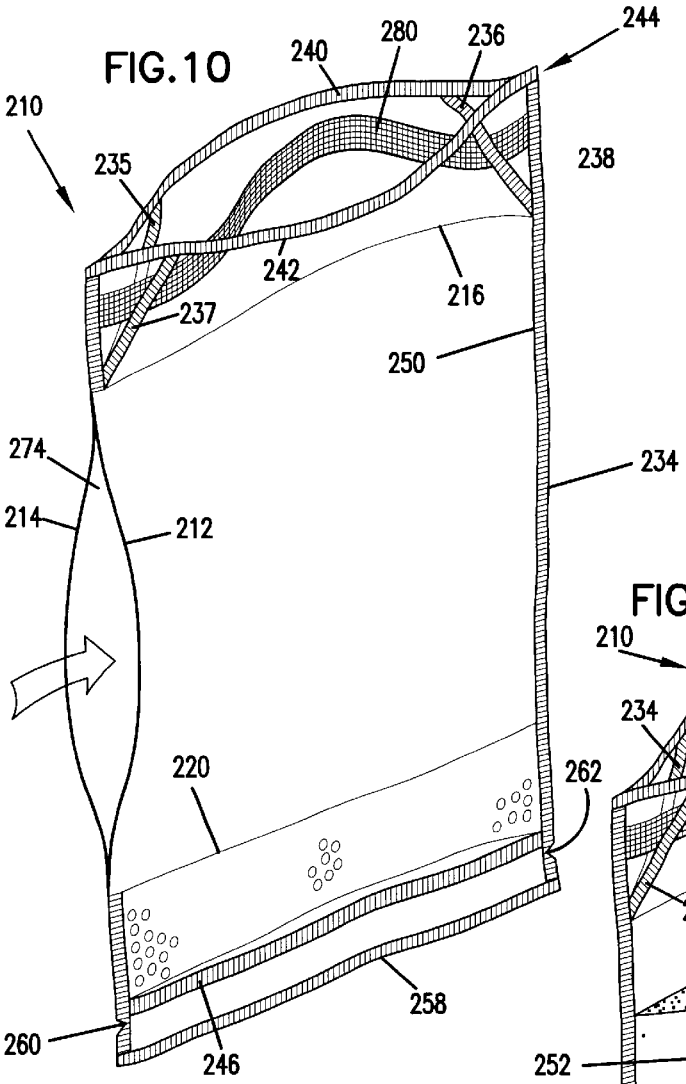
FIG. 10 is a perspective view of an alternate embodiment of the bag arrangement depicted in FIG. 7; the bag being shown during a filling operation through an opening in the side seal.
Figure 11:
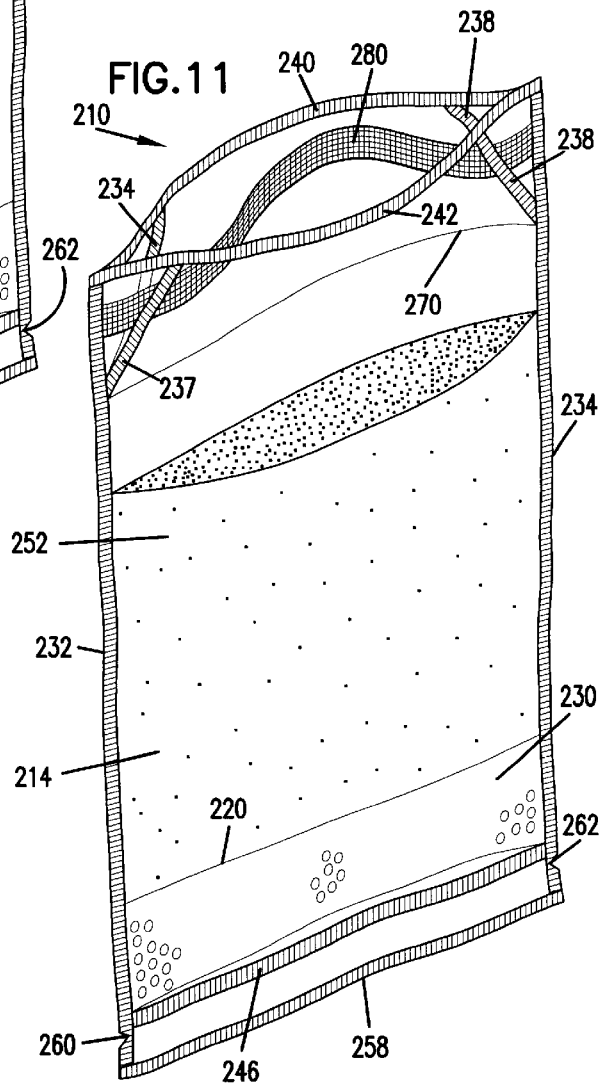
FIG. 11 is a perspective view of the bag arrangement depicted in FIG. 10 after the filling operation and after the opening in the side seal has been sealed.

Attention is now directed to FIGS. 10–11. From a review of these figures, further understanding regarding assembly and operation of arrangements, such as pouch arrangement 10, will be understood.

Referring to FIG. 10, the side seal 232 is shown in a stage before first and second panel sections 212, 214 are completely sealed to form the side seal 232. The pouch arrangement 210 is filled with material 252 through an opening or slit 274 where a side seal 232 is subsequently formed as described later. FIG. 10 shows the opening 274 extending between the first end 218 and second end 222 of the pouch arrangement 210. The first and second panel sections 212, 214 define an opening or slit 274 therebetween. The opening 274 provides access to the pouch interior 250.

Thus, it can be appreciated that the pouch arrangement 210 may be filled with material 252 through the opening 274. After filling the pouch arrangement 210 with material 252, the opening 274 may be closed, in order to provide a closed, stand-up gusset (that is, gusset 216). In FIG. 11, the side seal 232 is shown after the opening 274 has been closed. In a particular embodiment illustrated, the opening 274 is closed by a way of side seal 232, preferably by heat, by securing first and second panel sections, 212, 214. After forming the side seal 232, the pouch arrangement 210 is in a condition to be turned to rest on the bottom 224 and stand-up on its first gusset 116.

It should be understood that, in some embodiments, there may be a zipper closure arrangement along the seals 44, 46, 144, 146, 244 and 246 to permit selective opening and re-closing of the perforated, second gusset 20, 120 and 220. Such an arrangement is described fully in U.S. Pat. No. 5,709,479, which patent is incorporated herein by reference.

While a variety of methods may be utilized to prepare arrangements according to FIGS. 1–11, herein a preferred convenient method is described.

According to the method, two webs of material, each preferably being of approximately the same width and preferably continuous are provided. During the process, the two webs are brought together, in opposition to one another. It is these two webs, when cut in sections that form the opposite panels, for example panels 12 and 14 of the arrangement 10.

In a follow-up step, the two webs are brought together in opposition, ultimately to comprise panel sections 12 and 14. During the step of bringing the webs together, a continuous strip of gusset material is preferably fed there between along each of the appropriate edges. The gusset material forming the second gusset 20 may be pre-punched to include the distribution apertures. Alternatively, the punching operation may take place after the trimming and sealing steps. The gusset material forming the first gusset 16 is also provided along the appropriate edge.

In later steps of the process, a continuous composite that preferably comprises: a first web; a second web opposed to the first web; a first continuous gusset web; and a second continuous gusset web; is cut, trimmed, and sealed, preferably by heat sealing, into a pouch arrangement corresponding to the arrangement of FIG. 3A with opening 72. Embodiments that include a handle 180, 280, may include the handle in the continuous composite. The continuous composite that includes the handle 180, 280, can then be further processed as described above into a pouch arrangement 110, 210 corresponding to the arrangements of FIGS. 7–11 with opening 172 located along the first gusset 116 as show in FIGS. 7–9 or alternatively located along side seal 232, 234 as illustrated in FIGS. 10 and 11. It is contemplated that in some embodiments, all the seals may be formed and the opening 72, 172 and 272 cut in a subsequent step.

In some applications, it may be desirable to form the two webs from a single roll or web of material. This can be done, for example, by providing a primary web that is split in half, longitudinally, to form two webs. These webs can then be utilized as the two webs in the process.

Pouch arrangements as described herein may be provided with a variety of outer dimensions, depending upon the intended use. Example sizes include widths of at least 4 inches, no greater than 20 inches, and typically 6–18 inches; heights of at least 6 inches, no greater than 30 inches and typically 12–24 inches. The pouch arrangements 10 can be constructed to hold material 52, 152 and 252 of substantial mass, for example, 3–10 pounds, and in some cases, up to 30 pounds.

Pouch arrangements according to this disclosure may be manufactured from a variety of materials. Example materials include polyester biaxially oriented nylon linear low-density polyethylene (PET/BON/LLDPE) film.

The flowable material 52, 152 and 252 may be in a variety of forms including, for example, pellets, grains, seeds, or powders. In particular, materials 52, 152 and 252 can include salt pellets, grass seed, or plant nutrient. In general, the maximum average dimension of the flowable particulate material 52, 152 and 252 should be sufficiently smaller than the average size of the apertures in the base gusset member, to facilitate distribution. A variety of patterns of holes or apertures in the second gusset 20, 120 and 220, shapes of such apertures, sizes of such apertures, and population density of such apertures may be used. For example, in some arrangements, the distribution apertures will be approximately round, at least 1 mm in diameter, no greater than 8 cm. in diameter, and in some instances 1–6 cm. in diameter. For grass seed, for example, a diameter of about 2 cm. is convenient.

The above specification, examples and data provide a complete description of the manufacture and use of the invention. Many embodiments of the invention can be made.

What is claimed:

1. A pouch arrangement comprising:

(a) first and second opposed panel sections each having: opposite first and second ends; and first and second side edges extending between said first and second ends; said first side edge of first and second opposed panel sections define an opening therebetween providing access to an interior of the pouch arrangement;

(b) a first stand-up gusset fold member oriented between said first and second panel sections along said first and second panel section first ends; and (c) a second gusset oriented between said first and second panel sections along said first and second panel section second ends;

(i) said second gusset having a distribution aperture arrangement.

2. A pouch arrangement according to claim 1 further including:

(a) an end seal adjacent to said second gusset; said end seal securing together said second ends of said first and second panel sections wherein said end seal is constructed and arranged to be removable from remaining portions of the pouch arrangement.

3. A pouch arrangement according to claim 2 further including:

(a) a pair of tear notches adjacent to said end seal.

4. A pouch arrangement according to claim 1 further comprising:

(a) first and second side seals securing said first and second panel sections together along said first and second side edges;

(i) said first and second panel sections comprise two separate pieces of material; and (ii) said first stand-up gusset fold member is secured to each of said first and second panel sections along said first and second panel section first ends to provide a pouch arrangement having a completely closed, stand-up, bottom gusset.

5. A pouch arrangement according to claim 4 further including:

(a) flowable particulate material positioned in said pouch arrangement and located, at least in part, between said closed, stand-up, bottom gusset and said second gusset;

(i) said distribution aperture arrangement includes a plurality of distribution apertures; and (ii) said flowable particulate material having a maximum average dimension that is sufficiently smaller than an average size of said distribution apertures in said second gusset, so that said flowable particulate material can be readily, selectively, distributed through said second gusset.

6. A pouch arrangement according to claim 5 wherein:

(a) said distribution apertures are generally circular with a diameter of between 1 cm and 6 cm; and (b) said flowable particulate material is selected from the group consisting of pellets, grains, powders, seeds, plant nutrient, insect dust, and chalk.

7. A pouch arrangement according to claim 2 further comprising:

(a) a handle to permit a user to selectively carry and manipulate the pouch arrangement.

8. A pouch arrangement according to claim 4 further including:

(a) a handle fixed to said first and second side seals and extending along the first ends of said first and second panel sections.

9. A method of filling a pouch construction; the method comprising:

(a) providing a pouch construction having an interior, a first gusset fold member at a first end of the pouch construction, and a second gusset at a second end of the pouch construction;

(i) the second gusset including a plurality of apertures;

(ii) the second end of the pouch construction having a seal therealong to block external access to the second gusset; and (b) at least partially filling the pouch construction interior with a flowable material through an opening in the pouch construction;

(i) the step of at least partially filling includes filling the pouch construction through an opening in the pouch construction between the first end of the pouch construction and the second end of the pouch construction.

10. A method of filling according to claim 9 wherein:

(a) after said step of the least partially filling, sealing the opening to close access to the pouch construction interior and transform the opening into a side seal; and (b) after said step of sealing the opening, orienting the pouch construction into a standing configuration to stand on the closed, stand-up gusset.

11. A method of filling according to claim 9 wherein:

(a) said step of at least partially filling includes at least partially filling the pouch construction interior with one of pellets, grains, powders, seeds, plant nutrient, insect dust, and chalk.

12. A method of filling according to claim 10 wherein:

(a) said step of at least partially filling includes at least partially filling the pouch construction interior with one of pellets, grains, powders, seeds, plant nutrient, insect dust, and chalk.

13. A method of using a pouch; the method comprising:

(a) providing a pouch having first and second opposed panel sections defining an interior; a first end; and second, opposite end;

(i) a stand-up gusset at the first end; the stand-up gusset being material extending between the first and second opposed panel sections;

(ii) an end seal at the second end;

(iii) a flowable material in the pouch interior; and (b) removing the end seal from the pouch to expose a second gusset extending between the first and second opposed panel sections;

(i) the second gusset having a distribution aperture arrangement.

14. A method of using a pouch according to claim 13 further including:

(a) grasping a handle at the first end.

15. A method of using a pouch according to claim 13 further including:

(a) orienting the pouch such that the second gusset is located below the stand-up gusset;

(b) shaking the pouch to distribute the flowable material from the pouch interior through the aperture arrangement in the second gusset;

(c) after said step of shaking the pouch to distribute flowable material, orienting the pouch such that the stand-up gusset is located below the second gusset; and (d) standing the pouch in a stand-up configuration on the stand-up gusset.

16. A method of using a pouch according to claim 4 further including:

(a) orienting the pouch such that the second gusset is located below the handle and stand-up gusset;

(b) grasping the handle; and (c) shaking the pouch to distribute the flowable material from the pouch interior through the operative arrangement in the second gusset;

(d) after said step of shaking the pouch to distribute flowable material, orienting the pouch such that the stand-up gusset is located below the second gusset; and (e) standing the pouch in a stand-up configuration on the stand-up gusset.

17. A pouch arrangement comprising:

(a) first and second opposed panel sections each having: opposite first and second ends; and first and second side edges extending between said first and second ends;

(b) a first stand-up gusset fold member being an extension of material oriented between said first and second panel sections along said first and second panel section first ends; and (c) a second gusset being an extension of material oriented between said first and second panel sections along said first and second panel section second ends;

(i) said second gusset having a distribution aperture arrangement.

18. A pouch arrangement according to claim 17 wherein:

(a) said first stand-up gusset fold member and one of said first and second panel sections define an opening therebetween providing access to an interior of the pouch arrangement.

19. A pouch arrangement according to claim 17 further including:

(a) an end seal adjacent to said second gusset; said end seal securing together said second ends of said first and second panel sections wherein said end seal is constructed and arranged to be removable from remaining portions of the pouch arrangement.

20. A pouch arrangement according to claim 19 further including:

(a) a pair of tear notches adjacent to said end seal.

21. A pouch arrangement according to claim 17 further comprising:

(a) first and second side seals securing said first and second panel sections together along said first and second side edges;

(i) said first and second panel sections comprise two separate pieces of material; and (ii) said first stand-up gusset fold member is secured to each of said first and second panel sections along said first and second panel section first ends to provide a pouch arrangement having a completely closed, stand-up, bottom gusset.

22. A pouch arrangement according to claim 21 further including:

(a) flowable particulate material positioned in said pouch arrangement and located, at least in part, between said closed, stand-up, bottom gusset and said second gusset;

(i) said distribution aperture arrangement includes a plurality of distribution apertures; and (ii) said flowable particulate material having a maximum average dimension that is sufficiently smaller than an average size of said distribution apertures in said second gusset, so that said flowable particulate material can be readily, selectively, distributed through said second gusset.

23. A pouch arrangement according to claim 17 further comprising:

(a) a handle to permit a user to selectively carry and manipulate the pouch arrangement.

24. A pouch arrangement according to claim 23 further including:

(a) a handle fixed to first and second side seals and extending along first end of first and second panel sections.

25. A method of filling a pouch construction; the method comprising:

(a) providing a pouch construction having first and second opposed panel sections defining an interior; a first gusset fold member being material oriented between the first and second opposed panel sections at a first end of the pouch construction; and a second gusset being material oriented between the first and second opposed panel sections at a second end of the pouch construction;

(i) the second gusset including a plurality of apertures;

(ii) the second end of the pouch construction having a seal therealong to block external access to the second gusset; and p1 (b) at least partially filling the pouch construction interior with a flowable material through an opening in the pouch construction.

26. A method of filling according to claim 25 wherein:

(a) the step of at least partially filling includes filling the pouch construction through an opening in the pouch construction adjacent to the first gusset fold member;

(b) after said step of at least partially filling, sealing the opening to close access to the pouch construction interior and transform the first gusset fold member into a closed, stand-up gusset; and (c) after said step of sealing the opening, orienting the pouch construction into a standing configuration to stand on the closed, stand-up gusset.

27. A method of filling according to claim 26 wherein:

(a) said step of sealing includes securing a portion of the first gusset fold member to one of the first and second panel sections.

28. A method of filling according to claim 26 wherein:

(a) said step of at least partially filling includes at least partially filling the pouch construction interior with one of pellets, grains, powders, seeds, plant nutrient, insect dust, and chalk.

* * * * *

UNITED STATES PATENT AND TRADEMARK OFFICE

CERTIFICATE OF CORRECTION

PATENT NO. : 6,375,037 B1 
DATED : April 23, 2002
INVENTOR(S) : Gary M. Bell and Bobby Hira It is certified that error appears in the above-identified patent and that said Letters Patent is hereby corrected as shown below:

Column 12,
Line 14, delete "p1" and make a new paragraph starting with (b).

Signed and Sealed this

Twenty-fifth Day of June, 2002

*Attest:*

*Attesting Officer*

JAMES E. ROGAN
*Director of the United States Patent and Trademark Office*